United States Patent [19]

Nagel et al.

[11] 4,326,930

[45] Apr. 27, 1982

[54] METHOD FOR ELECTROLYTIC DEPOSITION OF METALS

[75] Inventors: Hartmut Nagel, Dortmund, Fed. Rep. of Germany; Samuel Stucki, Baden, Switzerland

[73] Assignee: BBC Brown, Boveri & Company, Limited, Baden, Switzerland

[21] Appl. No.: 10,684

[22] Filed: Feb. 9, 1979

[30] Foreign Application Priority Data

Apr. 14, 1978 [CH] Switzerland ..... 4005/78

[51] Int. Cl.[3] ..... C25D 5/54; C25D 5/56; C25D 7/04

[52] U.S. Cl. ..... 204/20; 204/24; 204/26

[58] Field of Search ..... 204/11, 20, 24, 26, 204/30

[56] References Cited

U.S. PATENT DOCUMENTS

| | | | |
|---|---|---|---|
| 2,474,502 | 6/1949 | Suchy | 204/20 |
| 2,737,541 | 3/1956 | Coolidge | 204/20 |
| 3,331,758 | 7/1967 | Levine | 204/26 |
| 3,407,125 | 10/1968 | Fehlner | 204/20 |
| 3,549,505 | 12/1970 | Hanusa | 204/11 |
| 4,053,371 | 10/1977 | Towsley | 204/26 |
| 4,204,918 | 5/1980 | McIntyre | 204/24 |

*Primary Examiner*—T. M. Tufariello

*Attorney, Agent, or Firm*—Oblon, Fisher, Spivak, McClelland & Maier

[57] ABSTRACT

A metal is electrolytically deposited on a nonconductive surface comprising impregnating a solid material with a reducible metal salt thereby forming a solid electrolyte material; placing the solid electrolyte material between an anode and a cathode thereby forming an electrolytic cell and impressing a current across the electrodes of a potential sufficient to electrolyze the metal ions thereby resulting in the deposition of a metal layer along the surface of the electrolyte adjacent the cathode.

23 Claims, 5 Drawing Figures

METHOD FOR ELECTROLYTIC DEPOSITION OF METALS

BACKGROUND OF THE INVENTION

1. Field of the Invention

The invention relates to a method for the electrolytic deposition of Group IB and VIII metals of the periodic table and in addition, Zn, Cd, Sn and Pb on a solid electrolyte. The invention relates further to an arrangement for conducting the method as well as to a product made thereby.

2. Description of the Prior Art

Of the methods for the coating of electronically nonconducting materials the best known are the so-called currentless deposition methods (e.g. F. A. Lowenheim ed., "Modern Electroplating," Bd. Edition, Wiley-Interscience, New York, 1974, Chapter 28, "Plating of Nonconductors," pp. 636–652, as well as the literature references and patents cited on pages 652–655). In these methods the substrate to be coated is immersed in a bath containing the metal ion concerned in simple or complex form, to which a reducing agent is gradually added. As a rule still other additives are mixed into the bath as stabilizers and accelerators. The substrate surface must be so constituted that it catalytically accelerates the reduction of the metal ion. Surfaces of electronic nonconductors must, before immersion in the bath, be activated by a suitable preliminary treatment (e.g. by dipping in $PdCl_2$ or $SnCl_2$ solutions).

The cited methods are involved and difficult and the yield of metal is often uneconomical, especially when costly metals (e.g. noble metals) are to be deposited. The baths must be tended and controlled extremely precisely with respect to pH value, concentrations of the reacting substances, impurities, temperature and other operating parameters. Often it is not possible to achieve an economically supportable optimization of all parameters, so that the output lags far behind the set goal. Moreover, solid electrolyte substrates coated via currentless deposition exhibit only small transverse electrical conductivity, and the metal layers are not adhesive enough in subsequent use (charging the electrolysis cell).

Industry places very demanding conditions on metal coatings of ionic conducting materials like solid electrolytes and ion-exchange membranes. Along with good adherence to the substrate, the metal layer should have the greatest possible specific surface area and a high transverse electronic conductivity while simultaneously guaranteeing good permeability (porosity) to liquids and gases. On the other hand, the amount of metal to be deposited per unit area of the substrate should be kept as low as possible.

SUMMARY OF THE INVENTION

Accordingly, an object of the present invention is to provide a method of electrolytically depositing a metal on an electrically non-conducting substrate which avoids the deposition of a metal on a substrate from reducible ions present in an electrolytic solution.

Another object of the present invention is to provide an electrically conductive metal layer on an electrically nonconductive substrate, said metal layer possessing high transverse electrical conductivity while simultaneously being porous to liquids and gases.

Briefly, these and other objects of the present invention as hereinafter will become more readily apparent can be attained by a method of electrolytically depositing a metal, particularly of Group IB or VIII as well as Zn, Cd, Sn, or Pb on a solid, electrically nonconductive surface comprising impregnating a solid material with a reducible metal salt thereby forming a solid electrolyte material; placing said solid electrolyte material between an anode and a cathode thereby forming an electrolytic cell; and impressing a current across said electrodes of a potential sufficient to electrolyze said metal ions thereby resulting in the deposition of a metal layer along the surface of said electrolyte adjacent said cathode.

By the technique of the present invention a strongly adherent metal layer can be deposited on a nonconducting surface while avoiding the use of chemical reducing agents, activators, stabilizers and accelerators and avoiding troublesome oversight of the deposition process. The deposited metal layer is strongly adhering and is porous.

The central feature of the present invention is that the support in the form of a solid electrolyte is first impregnated with the metal salt present in aqueous solution so that the salt, in dissolved form, is uniformly distributed and imbedded in the support, and the support is then subjected to electrolysis whereby the metal in elemental form is cathodically deposited on the support surface in finely divided, firmly adhering form.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
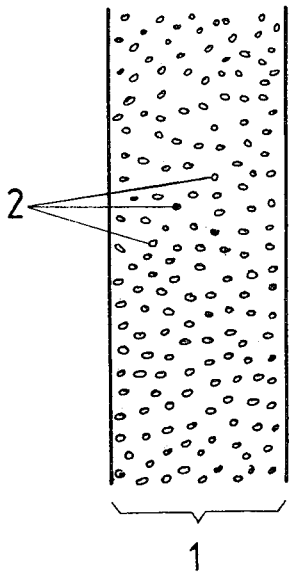
FIG. 1 is a cross-section through a solid electrolyte in the initial state saturated with a metal salt solution.

FIG. 1 represents a cross-section through a solid electrolyte 1, which is saturated with a metal salt solution 2 before the start of electrolysis. A plastic polymer, e.g. perfluorinated sulfo acids (known under the trade name "NAFION") can be used as solid electrolyte 1. The metal salt solution permeates the foil of solid electrolyte 1 completely so that the solid electrolyte is uniformly impregnated. The foil prepared in this manner is placed in the electrolysis cell described below.

Figure 2:
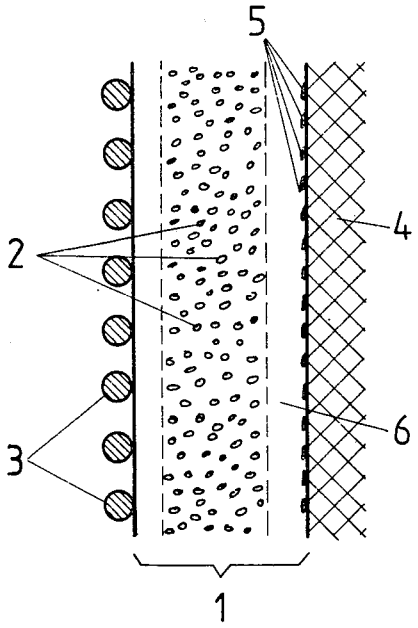
FIG. 2 is a cross-section through a solid electrolyte with anode, cathode and deposited metal at the beginning of electrolysis.

FIG. 2 shows a cross-section through the solid electrolyte 1 situated between the electrodes 3 and 4 just after the start of electrolysis (first phase). The anode 3 consists of a platinum grid, the cathode 4 of a graphite felt. The metal deposit 5 develops first in the form of small globules on the surface adjacent to the cathode 4, which globules grow further and further into the solid electrolyte foil 1 during the reduction process. Beneath the surface 1 adjacent cathode 4, a zone 6 depleted of the metal salt 2 develops.

Figure 3:
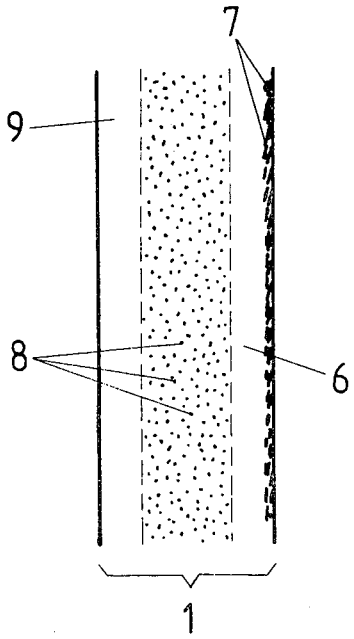
FIG. 3 is a cross-section through a solid electrolyte with deposited metal in the advanced phase of electrolysis.

FIG. 3 shows a cross-section through the solid electrolyte 1 at a later instant during electrolysis (second phase). The metal deposit 7 here has already attained some thickness and has grown further and further into the foil. Depleted zones 6 (cathode side) and 9 (anode side) develop, while simultaneously in the central zone the metal salt solution 2 is reduced to elemental finely divided metal particles 8.

Figure 4:
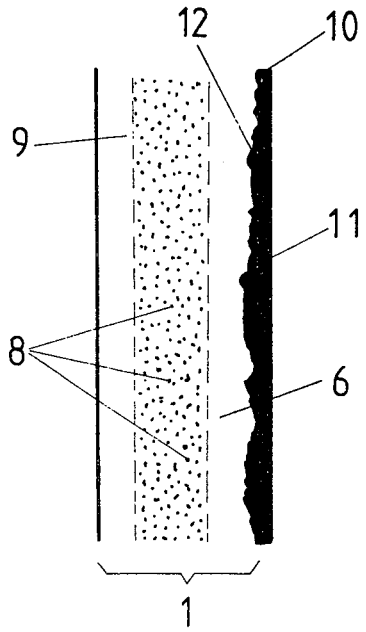
FIG. 4 is a cross-section through a solid electrolyte with deposited metal at the end of electrolysis.

In FIG. 4 is shown a cross-section through the solid electrolyte 1 at the end of electrolyis (third phase). The finished, more or less coherent metal deposit 10, which forms a relatively thick layer of high transverse conductivity, presents a shiny, smooth metal surface 11, while the metal surface 12 attached to and anchored in the solid electrolyte 1 is dull and dark in color, has a rough contour and fills up the pores of electrolyte 1.

Figure 5:
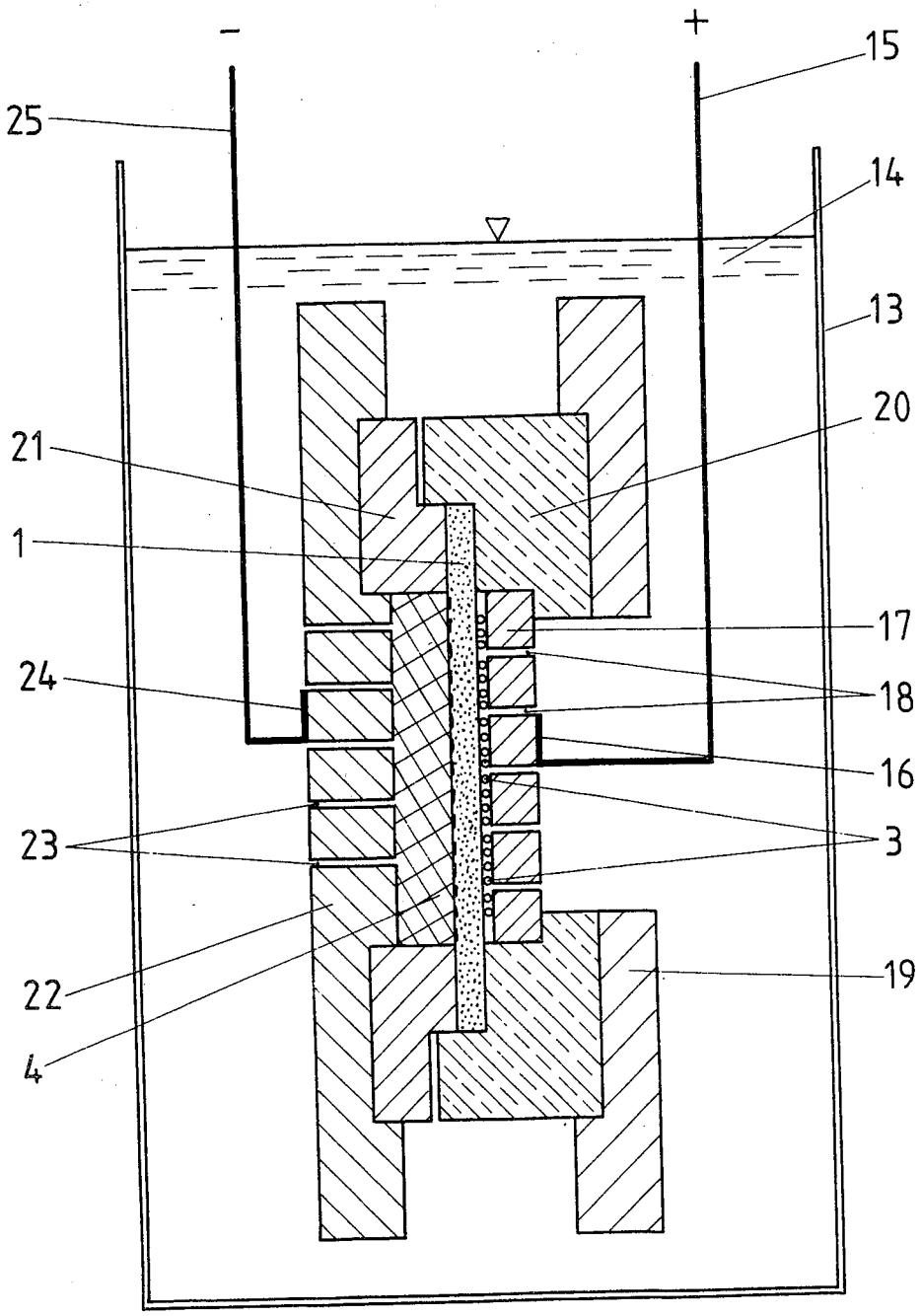
FIG. 5 is a section through an arrangement for deposition of metals (sandwich electrolysis cell).

FIG. 5 shows a section through an arrangement for the deposition of metals in the form of a sandwich electrolysis cell. The electrolysis tank 13 is filled with water 14 in which the sandwich electrolysis cell is immersed so as to be completely covered with water. Positive lead 15 supplies current and is connected via contact 16 to the positive holder plate 17 made of stainless steel or some other suitable chemically resistant alloy. The plate exhibits passages 18 for the flow of water. The packet consisting of the solid electrolyte 1 to be coated with metal along with the platinum-grid anode 3 and graphite-felt cathode 4 is held together by an anode-side 20 and a cathode-side 21 closure frame, where the former is in turn gripped in a holder frame 19 of stainless steel. Parts 20 and 21 of the closure frame are made of chemically resistant insulating material, preferably polytetrafluoroethylene (trade name "TEFLON"). Completing the closure is the holder plate 22 of corrosion resistant alloy (e.g. stainless steel) with passages 23 and connected to the negative lead 25 via the contact 24. The frame 19 and the plate 22 are held together by fastening elements not shown (e.g. screws, bolts, brackets).

EXAMPLE 1

A 0.5 g. amount of diammine platinum dinitrite, formula $Pt(NH_3)_2(NO_2)_2$, dissolved in 100 ml of distilled water at a temperature of 90° C. A circular foil of 30 mm diameter made of a plastic polymer based on perfluorinated sulfo acids (trade name "NAFION") was used as solid electrolyte 1. The foil in the dry, shrunken state was placed in the $Pt(NH_3)_2(NO_2)_2$ solution and was left in it for 30 minutes at a temperature of 90° C. The foil was then removed from the bath, rinsed with distilled water and placed in the electrolysis apparatus of FIG. 5. A platinum-wire grid 3 was used as the anode and a graphite felt 4 was used as the cathode. The entire assembled sandwich electrolysis cell was completely submerged in a bath of doubly distilled water 14 held at the constant temperature of 50° C. and was connected to a constant current source. Electrolysis was then carried out for an hour at a constant current density of 0.5 $A/cm^2$. Hydrogen was evolved at the cathode among other things and at the anode, oxygen. After completion of electrolysis the coated solid electrolyte 1 exhibited on the cathode side a shiny metallic Pt surface layer 11, while the reverse side 12, observed through the foil 1, appeared dull and black. After the coating the foil was boiled for 30 minutes in 1 N-hydrochloric acid to remove undeposited platinum. The structure of the foil is apparent from FIG. 4. The amount of the deposit on the foil surface was determined gravimetrically as 0.7 $mg/cm^2$ on the average.

The thickness of the metal layer deposited by this method was 0.5$\mu$ up to 2$\mu$ and the specific surface area was 50 to 150 $cm^2$ per $cm^2$ of solid surface. The specific resistance, measured parallel to the surface plane and referred to an area element of 1 cm width and 1 cm length in the current direction was 10 to 30 $\Omega$. The method does not have to be restricted to the exact operating parameters stated above. In particular, the concentration of the complex salt $Pt(NH_3)_2(NO_2)_2$ can vary in an advantageous manner within the limits of 0.05 to 0.6 g in 100 ml of distilled water. Naturally, with lower concentrations thinner metal layers are produced.

The same holds true for the performance of the electrolytic deposition. The current density can be chosen within the limits of 0.1 to 0.7 $A/cm^2$ and the temperature within the range of 30° to 60° C. Further the type of acid after treatment of the coated foil is not critical. Hot sulfuric acid can also be used.

EXAMPLE II

A 0.1 g amount of rhodiumchloridehydrate, $RhCl_3.3H_2O$, was dissolved in 50 ml of distilled water in a glass beaker. The solution was heated to 90° C. in order to form the hydrated ion of rhodium, i.e. $Rh_{aq}^{3+}$, which can be recognized by the color change from the initial dark red to yellowish red. Into this solution at 90° C. was placed a piece of the aforementioned "NAFION" foil (30 mm in diameter). After a soaking time of 30 minutes the yellowish orange colored foil was removed from the rhodium salt solution, rinsed with distilled water and incorporated in the electrolysis apparatus as in FIG. 5. After that the procedure was similar to that described under Example I. The conditions of deposition were: temperature 60° C.; current density 0.1 $A/cm^2$; duration of electrolysis 1 hour. The appearance of the coated foil was like that of the foil in Example I except that the layer was a shiny metallic rhodium layer. The after treatment of the foil was as described under Example I with hydrochloric acid.

The concentration of the solution used for impregnation in the present case can be chosen within the limits of 0.15 to 0.25 g $RhCl_3.3H_2O$ per 100 ml water. For the remainder of the operating parameters the previous remarks made under Example I hold true.

EXAMPLE III

A 0.1 g amount of iridiumchloride hydrate, $IrCl_3.3H_2O$, was dissolved in 40 ml of distilled water at a temperature of 60° C. The clear solution was mixed with 5 ml of concentrated ammonia water ($NH_{3aq}$) and 0.5 ml of diluted hydrazine solution ($H_2N—NH_2.H_2O$). Thereupon, a gradual change in color of the solution occurred towards violet. After an hour there was immersed in the 60° C. solution a plastic foil of the type discussed under Example I of 3 cm diameter. The solution was heated to 80° C. and the foil was impregnated for 30 minutes at this temperature. The iridium salt impregnated foil, which had a reddish appearance, was then placed in the electrolysis cell of FIG. 5. The electrolytic deposition of the metal was carried out in a closed pressure vessel (Parr Instruments, General Purpose Bomb) of 1000 ml content and $\frac{2}{3}$ filled with distilled water at a temperature of 140° C. and a pressure of 14 bar. The conditions of electrolysis were: current density 0.035 $A/cm^2$; duration 30 minutes. After the electrolysis the "NAFION"

foil was coated on the cathode side with a shiny metallic iridium layer.

The concentration of the solution can be chosen within the limits of 0.2 to 0.3 g $IrCl_3.3H_2O$ per 100 ml of water. For the remainder of the operating parameters the remarks made above in Example I hold true here also.

EXAMPLE IV

A 0.1 g amount of rutheniumchloride hydrate, $RuCl_3.3H_2O$, was dissolved in 40 ml of distilled water at a temperature of 60° C. The clear solution was mixed with 5 ml of concentrated ammonia water ($NH_{3aq}$) and 0.5 ml of diluted hydrazine solution ($H_2N—NH_2.H_2O$). For the remainder the procedure was exactly as given in Example III. The result was the same. For the remainder of the operating parameters the remarks made in Example III above hold true. Analogously, osmium can be deposited on a plastic foil impregnated with $OsCl_3.3H_2O$.

EXAMPLE V

A 0.2 g amount of anhydrous palladiumchloride, $PdCl_2$, was dissolved in 100 ml of distilled water at a temperature of 90° C. A "NAFION" foil was immersed in the solution and impregnated for 30 minutes at 90° C. The foil rinsed with distilled water was electrolyzed as in Example I for an hour at a temperature of 60° C. and a current density of 0.1 A/cm$^2$ in the sandwich electrolysis cell.

The concentration of the solution can be chosen anywhere in the range of 0.15 to 0.25 g $PdCl_2$ per 100 ml water.

EXAMPLE VI

A 0.2 g amount of anhydrous coppersulfate, $CuSO_4$, was dissolved in 100 ml of distilled water and the solution brought to a temperature of 90° C. A "NAFION" foil was impregnated with this solution at a temperature of 90° C. for 30 minutes. Thereafter, the procedure was similar to that of Example I with the conditions of electrolysis being as follows: current density 0.1 A/cm$^2$; temperature 30° to 40° C.; duration one hour. The concentration of the solution can be selected within the range of 0.15 to 0.25 g $CuSO_4$ per 100 ml water.

EXAMPLE VII

A 0.2 g amount of silvernitrate, $AgNO_3$, was dissolved in 100 ml of distilled water and the solution brought to a temperature of 90° C. A "NAFION" foil was treated with this solution as in Example VI and electrolyzed under analogous conditions. The concentration of the solution can vary from 0.15 to 0.25 g $AgNO_3$ per 100 ml water.

In a manner similar to that in Examples VI and VII gold can also be deposited, the trivalent chloride being recommended as starting material.

EXAMPLE VIII

A 0.5 g amount of nickelchloridehydrate, $NiCl_2.6H_2O$, was dissolved in 100 ml of distilled water. The solution heated to 90° C. was used for impregnation of a "NAFION" foil (soaking time: 30 minutes). The impregnated foil was then electrolyzed for 30 minutes at a current density of 0.2 A/cm$^2$ and at a temperature of 60° C. in the sandwich electrolysis cell. The concentration of the solution can be varied within the range of 0.4 to 0.6 g $NiCl_2.6H_2O$ per 100 ml water.

In this way the metals iron and cobalt can also be deposited, the chlorides or sulfates being recommended as starting materials.

EXAMPLE IX

A 0.5 g amount of zincacetatehydrate, $Zn(CH_3COO)_2.2H_2O$, was dissolved in 100 ml of distilled water. A "NAFION" foil was placed in the solution and soaked for 30 minutes at 90° C. Then the foil was electrolyzed for 30 minutes at a current density of 0.2 A/cm$^2$ and at a temperature of 25° C. in the sandwich electrolysis cell. The concentration of the solution can be 0.4 to 0.6 g $Zn(CH_3COO)_2.2H_2O$ per 100 ml water.

In a similar manner coatings of cadmium can also be produced starting advantageously with the hydrous acetate.

EXAMPLE X

A 0.5 g amount of tinsulfate, $SnSO_4$, was dissolved in 100 ml of distilled water and the solution was brought to a temperature of 90° C. A "NAFION" foil was soaked in this solution for 30 minutes at a temperature of 90° C., rinsed and electrolyzed in the sandwich cell for 30 minutes at 60° C. and a current density of 0.2 A/cm$^2$. The solution concentration can be between 0.4 and 0.6 g $SnSO_4$ per 100 ml water.

EXAMPLE XI

A 0.5 g amount of leadacetatehydrate, $Pb(CH_3COO)_2.3H_2O$, was dissolved in 100 ml of distilled water. The solution was brought to a temperature of 90° C. and a "NAFION" foil was soaked in the solution for 30 minutes. The impregnated foil was then electrolyzed for 30 minutes at a current density of 0.2 A/cm$^2$ and at a temperature of 60° C. The solution can have a concentration in the range of 0.4 to 0.6 g $Pb(CH_3COO)_2.3H_2O$ per 100 ml water.

The method of the invention is not limited to the above examples. In particular, other plastic polymers as well as inorganic (ceramic) solid electrolytes can also be coated in this manner. Moreover, metal salt solutions other than those described above can also be used for impregnation. The primary condition is that the metal be deposited from aqueous solution, that the solid electrolyte be permeable enough for water and the metal ions to be transported under the deposition conditions and that no harmful side reactions with the water and oxygen take place. This holds mainly for the metal itself deposited, in atomic form first, at the solid electrolyte/cathode boundary. It goes without saying that the alkali, alkaline earth and earth metals, which exhibit a high affinity for oxygen, are excluded from the method.

Through the method and arrangement of the invention, the coating of solid electrolytes in a simple manner with metals, particularly noble metals, is made possible, whereas by firmly adhering gas and liquid permeable surface layers exhibiting good physical properties are achieved. Since the metal is not applied from outside of the substrate surface but is initially present ionically inside the substrate in finely divided form and grows, as it were, into the surface from the interior, the anchoring of the metal particles is especially good and their strength of adherence is independent of the water content of the solid electrolyte, i.e. the metal layer does not peel-off when the latter dries out.

Such coated solid electrolytes are used to great advantage in electrolysis cells, particularly prominent amoung which are cells for hydrogen production.

Having now fully described this invention, it will be apparent to one of ordinary skill in the art that many changes and modifications can be made thereto without departing from the spirit or scope of the invention as set forth herein. ACCORDINGLY,

What is claimed as new and intended to be secured by Letters Patent is:

1. A method for electrolytic deposition of metals on a solid electricaly nonconductive surface, comprising:

impregnating a solid electrically nonconductive material with a reducible metal salt thereby forming a solid electrolyte material;

placing said solid electrolyte material between an anode and a cathode thereby forming an electrolytic cell;

immersing said cell in a container of distilled water maintained at a constant temperature; and impressing a current across said electrodes of a potential sufficient to electrolyze said metal ions thereby resulting in the deposition of a metal layer along the surface of said electrolyte adjacent said cathode.

2. the method of claim 1, wherein said impregnated solid electrolyte is sandwiched between the anode of a platinum grid and a graphite felt as the cathode.

3. The method of claim 1, wherein said solid material is a plastic polymer.

4. The method of claim 3, wherein said plastic polymer is a foil composed of perfluorinated sulfo acid.

5. The method of claim 1, which further comprises:

drying said solid electrolyte material prior to impregnation;

rinsing said impregnated solid electrolyte material in distilled water;

immersing said cell in a container of distilled water maintained at a constant temperature; and impressing said current across said electrodes at a constant current density.

6. The method of claim 5, wherein said reducible metal salt is a platinum group element which is impregnated in said solid electrolyte in solution as a chloride or as a complex salt.

7. The method of claim 6, wherein said solid electrolyte material coated with deposited metal is boiled in a bath of 1 N-hydrochloric acid for one-half hour.

8. The method of claim 6, wherein said platinum group metal salt is a diammine platinum dinitrite complex salt.

9. The method of claim 8, wherein said metal salt solution is 0.05 to 0.6 g of $Pt(NH_3)_2.(NO_2)_2$ dissolved in 100 ml of distilled water at 90° C., wherein the impregnated solid electrolyte is electrolyzed for an hour at a current density of 0.5 A/cm$^2$ and a temperature of 50° C.

10. The method of claim 6, wherein said metal salt solution is 0.15 to 0.25 g of $RhCl_3.3H_2O$ in 100 ml of distilled water, said solution is brought to 90° C. and the solid electrolyte is impregnated with said solution for 30 minutes at 90° C., and wherein the impregnated solid electrolyte is electrolyzed for an hour at a current density of 0.1 A/cm$^2$ and a temperature of 60° C.

11. The method of claim 6, wherein said metal salt solution is 0.2 to 0.3 g of $IrCl_3.3H_2O$ or $RuCl_3.3H_2O$ dissolved in 100 ml of distilled water, said solution being mixed with 10 to 15 ml of concentrated $NH_{3aq}$ and 0.5 ml of diluted hydrazine solution $H_2N—NH_2.H_2O$ and allowed to stand for one hour at 60° C., and wherein the solid electrolyte is impregnated with said solution for 30 minutes at 80° C., and the impregnated solid electrolyte is electrolyzed for 30 minutes at a current density of 0.035 A/cm$^2$ and a temperature of 140° C. under a pressure of 14 bar in a pressure vessel.

12. The method of claim 6, wherein said metal salt solution is 0.15 to 0.25 g of $PdCl_2$ dissolved in 100 ml of distilled $H_2O$ at 90° C., and the solid electrolyte is impregnated with said solution for 30 minutes at 90° C., and wherein the impregnated solid electrolyte is electrolyzed for an hour at a current density of 0.1 A/cm$^2$ and a temperature of 60° C.

13. The method of claim 5, wherein said metal salt solution is 0.15 to 0.25 g of $CuSO_4$ or $AgNO_3$ dissolved in 100 ml of distilled $H_2O$ and the solid electrolyte is impregnated with said solution for 30 minutes at 90° C., and wherein the impregnated solid electrolyte is electrolyzed for an hour at a current density of 0.1 A/cm$^2$ and a temperature of 30° to 40° C.

14. The method of claim 5, wherein said metal salt solution is 0.4 to 0.6 of $NiCl_2.6H_2O$ dissolved in 100 ml distilled water at 90° C. and the solid electrolyte is impregnated with said solution for 30 minutes at 90° C., and wherein the impregnated solid electrolyte is electrolyzed for 30 minutes at a current density of 0.2 A/cm$^2$ and a temperature of 60° C.

15. The method of claim 5, wherein said metal salt solution is 0.4 to 0.6 g of $Zn(CH_3COO)_2.2H_2O$ dissolved in 100 ml of distilled water at 90° C. and the solid electrolyte is impregnated with said solution for 30 minutes at 90° C., and wherein the impregnated solid electrolyte is electrolyzed for 30 minutes at a current density of 0.2 A/cm$^2$ and a temperature of 25° C.

16. The method of claim 5, wherein said metal salt solution is a 0.4 to 0.6% solution of $SnSO_4$ in distilled water and the solid electrolyte is impregnated for 30 minutes at 90° C. with said solution, and wherein the impregnated solid electrolyte is electrolyzed for 30 minutes at a temperature of 60° C. and a current density of 0.2 A/cm$^2$.

17. The method of claim 5, wherein said metal salt solution is 0.4 to 0.6 g of $Pb(CH_3COO)_2.3H_2O$ dissolved in 100 ml of distilled water at 90° C. and the solid electrolyte is impregnated with said solution for 30 minutes at 90° C., and wherein the impregnated solid electrolyte is electrolyzed for 30 minutes at a current density of 0.2 A/cm$^2$ and a temperature of 60° C.

18. A solid electrolyte material coated on a surface with a layer of finely divided metal particles prepared by the method of claim 1, wherein said finely divided deposited metal has a specific surface area of 50 to 150 cm$^2$ per cm$^2$ and wherein particles being firmly attached to said surface with the adherence of said metal particles being independent of the water content of the solid electrolyte.

19. The solid electrolyte of claim 18, wherein said solid material is a foil based on perfluorinated sulfo acids.

20. The solid electrolyte of claim 18, wherein said finely divided metal is platinum, rhodium, iridium, osmium, palladium, ruthenium or a mixture of at least two of the metals and wherein said metal surface layer exhibits a resistance, measured parallel to the surface plane, of 10 to 30Ω based upon a surface element 1 cm wide and 1 cm long in the current direction.

21. The solid electrolyte of claim 18, wherein said finely divided metal is iron, nickel or cobalt or a mixture of at least two of the said metals.

22. The solid electrolyte of claim 18, wherein said deposited metal layer is copper, silver, gold or a mixture of at least two of said metals.

23. The solid electrolyte of claim 18, wherein said deposited metal layer is zinc, cadmium, tin or lead.

* * * * *